US005253779A

United States Patent [19]

Lee

[11] Patent Number: 5,253,779

[45] Date of Patent: Oct. 19, 1993

[54] BEVERAGE CONTAINER HAVING A SELF-CONTAINED POP-UP STRAW ASSEMBLY

[76] Inventor: Gul N. Lee, 13346 Ridgecrest La., Cerritos, Calif. 90701

[21] Appl. No.: 817,264

[22] Filed: Jan. 3, 1992

[51] Int. Cl.[5] ..... B65D 17/34; A47G 19/22

[52] U.S. Cl. ..... 220/705; 220/270; 220/706; 215/1 A; 229/103.1; 239/33

[58] Field of Search ..... 220/270, 705, 706, 708, 220/709, 710; 215/1 A, 229; 229/103.1; 239/33

[56] References Cited

U.S. PATENT DOCUMENTS

| | | | |
|---|---|---|---|
| 942,306 | 12/1909 | Clarke | 215/1 A |
| 2,194,011 | 3/1940 | Davidson | 229/103.1 |
| 2,392,479 | 1/1946 | Humbert | 229/103.1 |
| 2,748,968 | 6/1956 | Attler | 215/229 X |
| 2,805,809 | 9/1957 | Pugh | 229/103.1 |
| 2,948,453 | 8/1960 | Drown | 229/103.1 |
| 3,173,566 | 3/1965 | Talbert | 215/229 |
| 3,220,587 | 11/1965 | Griffin et al. | 229/103.1 X |
| 3,226,001 | 12/1965 | Sequeira | 229/103.1 |
| 3,295,715 | 1/1967 | Pugh | 220/270 X |
| 3,303,984 | 2/1967 | Jurena | 229/103.1 |
| 3,349,955 | 10/1967 | Cornelius | 220/270 X |
| 3,362,572 | 1/1968 | Pelley | 220/270 |
| 3,547,308 | 12/1970 | Gilliem . | |
| 3,746,197 | 7/1973 | Sather | 215/1 A |
| 3,776,458 | 12/1973 | Chunga, Sr. | 215/1 A X |
| 4,109,817 | 8/1978 | Payne et al. | 220/706 |
| 4,176,760 | 12/1979 | Roth | 220/359 |
| 4,228,913 | 10/1980 | Mack et al. | 229/103.1 X |
| 4,244,474 | 1/1981 | Wise | 229/103.1 X |
| 4,448,316 | 5/1984 | Hiroshige | 215/1 A |
| 4,582,213 | 4/1986 | Park et al. | 229/103.1 X |
| 4,650,088 | 3/1987 | Hirota et al. | 220/270 |
| 4,709,829 | 12/1987 | Johnson et al. | 229/103.1 X |
| 4,712,702 | 12/1987 | Ayabe et al. | 229/103.1 X |
| 4,744,477 | 5/1988 | Wofford | 215/229 |
| 4,877,148 | 10/1989 | Larson et al. | 229/103.1 X |
| 4,893,725 | 1/1990 | Ball et al. | 220/269 |

*Primary Examiner*—Gary E. Elkins
*Assistant Examiner*—Vanessa Caretto
*Attorney, Agent, or Firm*—Robbins, Berliner & Carson

[57] ABSTRACT

A beverage container having a sloping upper wall and enclosing a self-contained pop-up straw assembly. The straw assembly has telescopic inner and outer tubes and resilient means urging the tubes against the sloping container wall, causing the straw assembly to center itself and pop-up when the container is opened.

14 Claims, 2 Drawing Sheets

BEVERAGE CONTAINER HAVING A SELF-CONTAINED POP-UP STRAW ASSEMBLY

FIELD OF THE INVENTION

This invention relates to a beverage container that incorporates its own straw assembly, and the straw assembly itself.

BACKGROUND OF THE INVENTION

Beverage containers having self contained straws have been known for years including those which incorporate tab tops, but even with growing environmental concerns, none of them have been successful in being widely adopted. The advantages of a completely self contained drinking unit are evident. Not only does such a unit provide a sanitary means of access to the beverage but avoids the waste of paper covering used to enclose sanitized straws. Drawbacks of prior devices relate to their inability to be aligned with the opening of the container without expensive mechanisms, complicated installation and/or inordinate manufacturing costs.

Larson et al U.S. Pat. No. 4,877,148 discloses mechanisms for incorporating a pop-up straw into various types of containers such as beverage cans and bottles. In each case, the top of the straw is retained by a lip adjacent the container opening so that projecting the straw from the container requires some means of reacting with a pushed in surface to free the straw from the lip. A coiled spring of plastic line is disclosed in FIG. 9 of Larson et al that acts in conjunction with accordion pleats. Not only does this require a pleating operation on the straw itself, but exposes one to the danger of a loose coil spring floating in the beverage.

Cornelius U.S. Pat. No. 3,349,955 discloses a beverage container with a pop-up straw which requires a specially constructed tubular member on the bottom side of a lipped can; this presents expenses not only in converting a simple can structure to a complex structure, but also requires one to accurately align the top of the straw with the tubular member.

Gilliem U.S. Pat. No. 3,547,308 discloses various means for popping a straw out of a can including a spring-biased bellows, a float and a coil spring. The coil spring is mounted within the bellows itself or externally to the straw. In any event, a mechanism of substantial complexity is required, necessitating extensive modification of the normal structure of the beverage can.

Mack et al U.S. Pat. No. 4,228,913, discloses a beverage can including a straw with a bellows section which automatically raises the straw. A separate and complex straw retainer and guide is required to be affixed internally of the can.

Johnson et al U.S. Pat. No. 4,709,829, discloses a pop-up straw for a beverage can in which the straw not only has pleats but is also fitted with a float and must be preset into an orifice structure serving to center the straw.

Pugh U.S. Pat. No. 3,295,715; Park et al U.S. Pat. No. 4,582,213; and Ayabe et al U.S. Pat. No. 4,712,702, each disclose complex opening mechanisms in which a straw is attached to the pull tab of a container.

Sequeira U.S. Pat. No. 3,226,001, discloses a modification to a can or bottle closure which includes a slot or aperture sized to retain the straw so that when the tab or bottle cap is removed, the straw must be grasped by the fingers to be withdrawn.

All the above containers include some mechanism for securing the straw in a particular position within the container, many of which involve fairly complex and expensive structures. The present invention provides a simple, inexpensive mechanism that not only provides a pop-up capability to a straw assembly but automatically centers the straw so that assembly with the container is simple. A unique straw assembly is provided for use with containers that have a sloping upper surface. More specifically, a beverage container having a sloping upper wall is provided having an enclosed self contained pop-up straw assembly formed of telescopic tubes and resilient means urging the tubes apart against the sloping wall. The straw assembly tends to center itself in the container and pop up when the container is opened.

The container can be a bottle having a neck providing a sloping wall, or can be a carton with a gabled top. In a preferred embodiment, the container is a cylindrical can in which the sloping wall constitutes the top wall of the can. The slope defines an apex, preferably centrally on the can top, formed with tab cap closure disposed on the apex and movable, e.g., backwardly bendable, to expose the contents of the container. By reason of its spring construction, the straw centers itself to the apex so that when the tab cap is bent back, the straw is released and projects out of the opening, i.e., it pops up.

The straw assembly comprises telescoping inner and outer tubes with the bottom end of the inner tube being integrally formed with a coil that extends into the bottom end of the outer tube. The tubes have sufficient clearance to enable them to telescopically slide with respect to each other, but not so large as to impede the drawing of liquid up through the inner tube. A clearance of about 0.1–0.3 millimeter is generally sufficient to provide the desired results.

The present invention overcomes the disadvantages of prior art straw assemblies by providing a straw which is very simple in construction yet operates with simple surfaces of the container to center itself and project from the container when it is opened.

DETAILED DESCRIPTION

Figure 1:
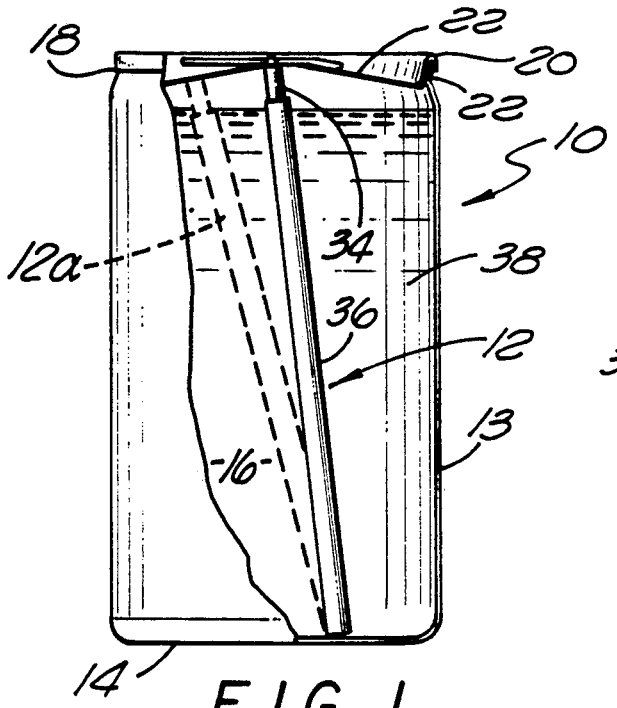
FIG. 1 is an elevational view partly in section showing a beverage container and straw assembly according to the present invention.

Referring to FIG. 1, there is shown a beverage container 10 and straw assembly 12. The container 10 is in the form of a can including a cylindrical sidewall 13 and a bottom wall 14 defining a beverage containing chamber 16. In a typical can body configuration, the bottom wall 14 is integral with the cylindrical sidewall 13 of the can body wherein the body is of aluminum formed by a drawing operation. The upper end is a seam 18 that includes a flange 20 which is interlocked with a top wall 22.

Figure 2:
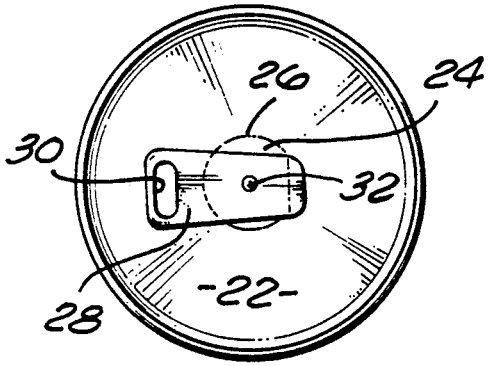
FIG. 2 is a top plain view of the assembly of FIG. 1.

Referring additionally to FIG. 2, the top wall 22 is of sheet metal configuration, typically of aluminum or steel. Contrary to typical can configurations, the top wall 22 is convex, formed with a sloping wall and having a central apex which is defined by an annular removable cap section 24 defined in part by a mostly circular line of weakness 26. An opening tab 28 having a finger opening 30, for gripping, is secured to the cap section 24 by a rivet 32 to form a tab cap closure for the can assembly 10.

Referring again to FIG. 1, the straw assembly 12 is constituted by inner and outer telescoping tubes 34 and 36 respectively. The tubes are urged apart by a resilient means, which will be described in more detail hereinafter, so that when the straw assembly is enclosed within the can, the inner tube is urged by the resilient means against the sloping surface of the top wall 22, and due to the sloping nature of that wall centers itself immediately below the removable cap section 24. The can 10 encloses a beverage 38 in which the straw assembly 12 is immersed.

Figure 3:
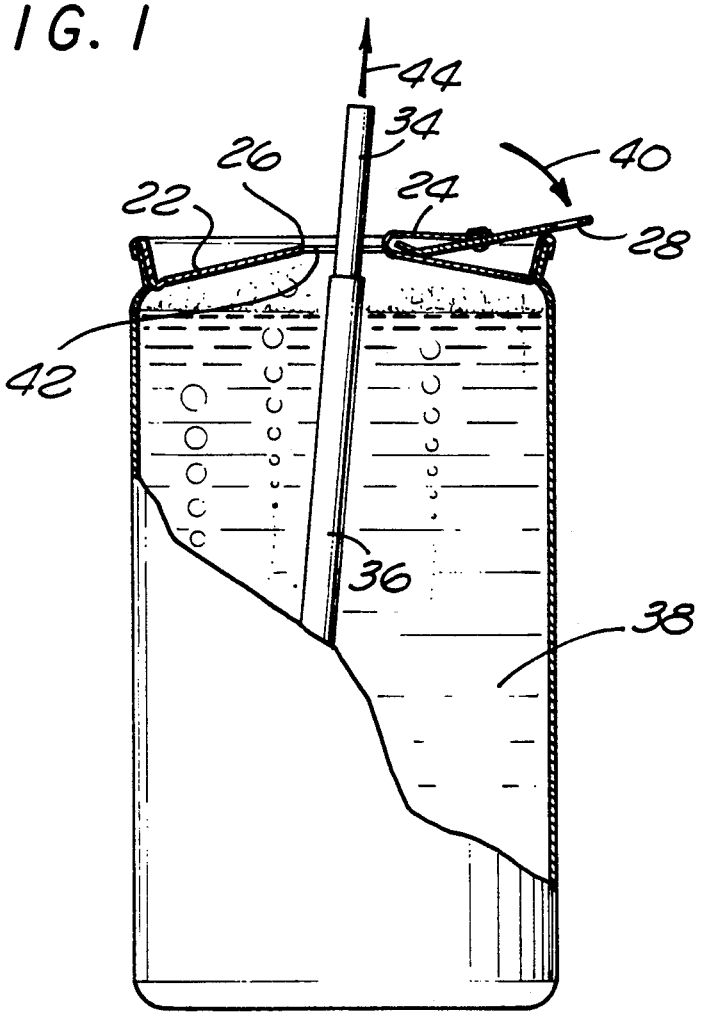
FIG. 3 is a partially sectioned elevational view showing the straw assembly projecting out of the opened container.

Referring now to FIG. 3, backward pivoting of the tab 28 tears the cap 24 from the top wall 22 along the line of weakness 26 by means of a backwardly bending action of the tab 28 as shown by the arrow 40, leaving an opening 42. As shown by the arrow 44, the inner straw tube 34 telescopes upwardly from the outer tube 36 to pop-up through the opening 42. One can then simply sip the beverage 38 through the inner straw tube 34.

Figure 4:
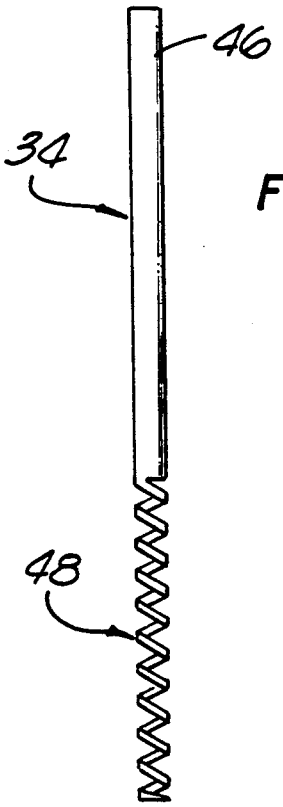
FIG. 4 is an elevational view of the inner tube of the straw assembly showing the integral spring.
Figure 5:
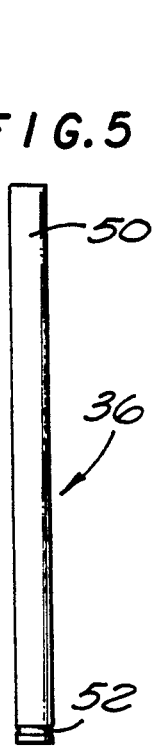
FIG. 5 is an elevational view showing the outer tube of the straw assembly.

FIGS. 4 through 7 illustrate in detail the construction of the straw assembly 12. The inner straw tube 34 is shown in FIG. 4 and consists integrally of a short piece of tubing 46 terminating at its bottom end in a resilient coil structure 48. The inner straw tube 34 is formed from a springy material that will not take a set and which exhibits no significant decomposition in water or in the typical beverage 38 contained in the can assembly 10, and also should be odorless and tasteless. Such properties are exhibited by a number of organic plastics, polyethylene, for example.

The outer straw tube 36 also can be formed of the same organic plastic as the inner tube 34. It consists of a tubular section 50 which in this embodiment is longer than the tubular section 46 (but in another embodiment the outer tube 36 may be the same size or may be shorter) and is formed with an annular groove 52 at its bottom end.

Figure 6:
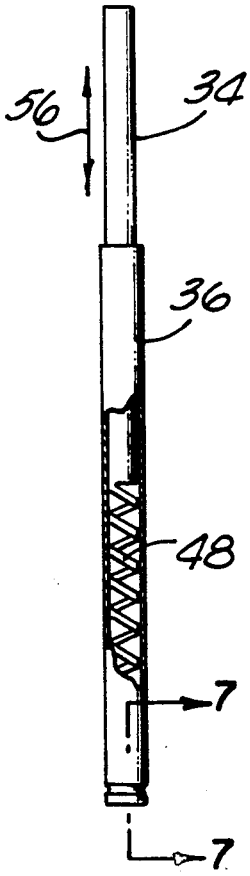
FIG. 6 is an elevational view, partly in section, showing the inner and outer tubes telescopically assembled.
Figure 7:
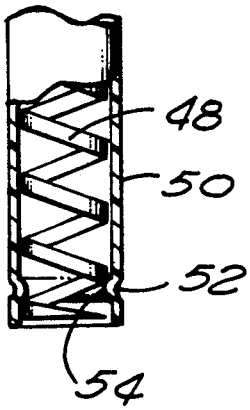
FIG. 7 is an enlargement in cross-section along line 7—7 of FIG. 6 showing the means of engagement of the inner tube coil to the outer tube.

Referring to FIG. 6, the inner straw tube 34 is telescopically disposed into the outer straw tube 36 so that the integral coil 48 extends into the bottom of the outer tube 36. Referring additionally to FIG. 7, the angular groove 52 forms an internal rib 54 which retains the coil 48 against upward movement. Because of the springiness of the coil 48, in assembling the straw, one simply has to push the inner tube 34 into the outer tube 36 until the end of the coil 48 meets the internal rib 54 whereupon it slides past that rib, to be secured. As indicated by the arrow 56 in FIG. 6, the inner straw tube 34 can be moved up or down. Referring back to FIG. 1, during assembly, after filling the can with the beverage 38, prior to installation of the top wall 22, the straw assembly 12 is placed into the can as shown as shadow at 12*a* in FIG. 1. Upon securing the top wall 22, the inner straw tube 34 is urged against the sloping surface of the top wall 22 and moves until it is centered.

The outer diameter of the inner tube 34 is slightly smaller than the inner diameter of the outer tube 36, with just sufficient clearance to allow the tubes to be telescopically urged apart by the resilient spring coil 48, but not so great that beverage going into the bottom of the outer tube 36 does not get drawn up by sipping action on the inner tube 34. Generally, a clearance of about 0.1–0.3 millimeter is satisfactory, although a fair range of clearance can be accommodated with satisfactory operation. The exact optimal clearance would depend upon such factors as the surface properties of the plastic material constituting the straw tubes 34, 36 and the spring moment of the coil 48.

Figure 8:
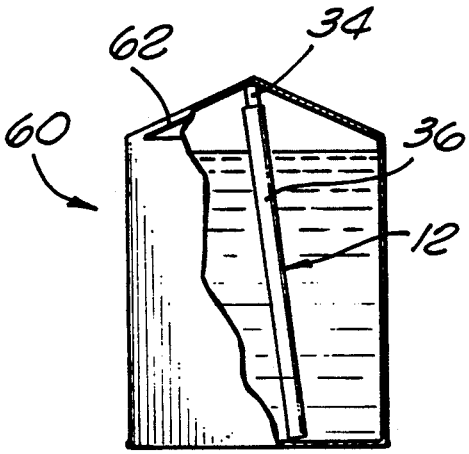
FIG. 8 is an elevational view partly in section showing a milk carton and straw assembly according to the present invention.

Referring now to FIG. 8, a carton is schematically shown such as a typical milk carton 60 with a gabled top 62. The top 62 provides a sloping surface sufficient for centering the straw assembly 12 of inner and outer straw tubes 34 and 36 respectively. The straw assembly is identical to that provided in FIGS. 4–7 and placed in the carton so as to angle toward an openable corner. As the gabled structured is flayed open, to expose the contents of the carton, the inner straw tube 34 will pop out.

Figure 9:
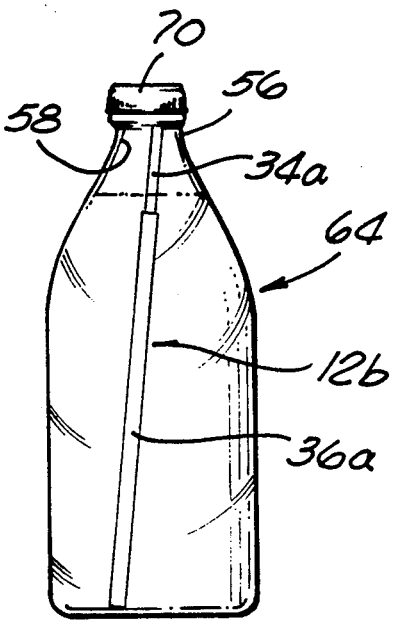
FIG. 9 is an elevational view of a bottle containing a straw assembly of this invention.

FIG. 9 illustrates the use of the straw assembly of FIGS. 4–7, but somewhat more elongated, in a typical bottle 64 terminating with a neck 56 that provides a sloping surface 58 against which the straw assembly 12*b* can react. The inner straw tube 34*a* is urged away from the outer tube 36*a* so that it is centered on a cap 70 used to close the mouth of the bottle 64. Upon removal of the cap 70, the inner tube 34*b* pops up out of the bottle mouth.

While I have specifically illustrated and described preferred embodiments of my invention, it should be understood that modifications or variations are possible in light of the above teachings.

I claim:

1. A beverage container having a self-contained pop-up straw assembly comprising:

a container body having bottom and side walls and a sloping top wall terminating in a closure and defining a beverage chamber; and a drinking straw assembly enclosed in said chamber, comprising telescoping inner and outer tubes, said inner tube terminating in a coil, as an integral extension of one of its ends, disposed within said outer tube and constituting resilient means to urge said tubes apart against said sliping wall whereby to cause said straw assembly to tend to center itself in said container and project out of said container when said closure is open.

2. The container of claim 1 in which said container body is a cylindrical can, the slope of the top wall defining an apex, and said closure constituting a tab cap disposed on said apex and movable to open said container while releasing said straw assembly.

3. The container of claim 2 in which said tab cap is backwardly bendable.

4. The container of claim 2 in which said apex is defined centrally of said upper wall.

5. The container of claim 1 in which said container body is a cylindrical bottle having a neck, said sloping wall constituting the neck of said bottle terminating in a mouth, said closure constituting a removable cap closing said mouth.

6. The container of claim 1 in which said container body is a carton, said sloping upper walls constituting a gabled top thereof.

7. The container of claim 1 in which said outer tube has first and second ends, said inner tube protruding from a first end of said outer tube and including means on the second end of said outer tube for engaging said coil.

8. The container of claim 1 in which said telescoping tubes have a clearance between them of about 0.1–0.3 millimeter.

9. A beverage container having a self-contained pop-up straw assembly, comprising:

a cylindrical can having bottom, side and top walls defining a beverage chamber, said top wall being convex and terminating centrally in an apex;

a tab cap disposed on said apex, backwardly bendable to open said can; and a drinking straw assembly enclosed in said chamber, comprising telescoping inner and outer tubes, each having upper and lower ends, the upper end of said inner tube protruding from the upper end of said outer tube, the lower end of said inner tube being integrally formed with a downwardly extending coil urging said tubes apart against said convex top wall whereby to cause said straw assembly to tend to center itself in said can and project out of said can when said can is open.

10. The container of claim 9 in which the lower end of said outer tube is formed to engage said coil.

11. The container of claim 9 in which telescoping tubes have a clearance between them of about 0.1–0.3 millimeter.

12. A straw assembly, comprising telescoping inner and outer tubes, each having first and second ends, the first end of said inner tube protruding from the first end of said outer tube, the second end of said inner tube being integrally formed with a coil extending into the second end of said outer tube.

13. The straw assembly of claim 12 in which the second end of said outer tube is formed to engage said coil whereby said coil urges said tubes apart when said tubes are telescoped together.

14. The straw assembly of claim 12 in which said telescoping tubes have a clearance between them of about 0.1–0.3 millimeter.

* * * * *